US005347683A

United States Patent [19]

Halligan et al.

[11] Patent Number: 5,347,683

[45] Date of Patent: Sep. 20, 1994

[54] CURTAIN ROD AND ATTACHMENT SYSTEM

[76] Inventors: Francis Halligan, 207 S. Dillwyn Rd., Newark, Del. 19711; Daniel Walsh, 1456 Bronte Ct., Landsdale, Pa. 19446

[21] Appl. No.: 928,932

[22] Filed: Aug. 11, 1992

[51] Int. Cl.[5] ..... A47H 15/00

[52] U.S. Cl. ..... 16/87.4 R; 160/330; 160/368.1; 16/87.6 R; 16/93 D

[58] Field of Search ..... 160/330, 368.1, 345; 16/87.2, 87.4 R, 87.6 R, 87.8, 93 D, 95 D, 96 D; 24/105.2; 248/261

[56] References Cited

U.S. PATENT DOCUMENTS

| | | | |
|---|---|---|---|
| 2,848,734 | 8/1958 | Ault | 160/345 X |
| 2,890,799 | 6/1959 | Rosenbaum | 211/105.2 |
| 3,234,997 | 2/1966 | Ford | 160/345 |
| 3,615,272 | 10/1991 | Ehrlich | 160/330 |
| 3,703,740 | 11/1972 | Mann et al. | 16/87.2 |
| 3,927,437 | 12/1975 | Ford | 160/345 X |
| 4,785,867 | 11/1988 | Darner | 160/345 |
| 5,109,912 | 5/1992 | Gary | 160/330 |

*Primary Examiner*—Blair M. Johnson
*Attorney, Agent, or Firm*—Sheldon H. Parker

[57] ABSTRACT

A curtain hanging device is disclosed. The curtain hanging device features a rod which has a rectangular cross section composed of a first surface, a second surface, a third surface, a fourth surface, and a fifth surface. The first and fifth surfaces of the rod lie within the same plane and are spaced opposite and parallel to the plane of the third surface. The first and fifth surfaces have a lateral dimension less than that of the third surface and are spaced from each other, such that a channel is formed along the length of the curtain hanging device. The curtain hanging device includes at least one I shaped slide member. The I shaped slide member has a first end, a second end and a web connecting the first and second ends. The first end has a pair of side surfaces and is dimensioned to slide within and along the channel such that the pair of side surfaces remain parallel to the second and forth surfaces. The second end has a grooved surface and a pair of horizontal surfaces. The grooved surface has a concave groove extending substantially perpendicular to the direction of travel of the I shaped slide member along the channel. The horizontal surfaces abut the grooved surface. The curtain hanging device also includes an overlay. The overlay has an affixing means and a brace portion. The affixing means are disposed to allow removably affixing the overlay to the I shaped slide member. The brace portion has a mating surface and an attachment surface. The mating surface has a convex portion dimensioned to mate with the concave grooved surface of the second end of the I shaped slide member. The attachment surface is provided with one portion of a two portion self-adhering material.

26 Claims, 4 Drawing Sheets

CURTAIN ROD AND ATTACHMENT SYSTEM

BACKGROUND OF THE INVENTION

1. Brief Description of the Invention

The instant invention discloses a novel curtain rod and attachment system using a hook and fabric or hook and loop attachment system of the type sold under the trademark Velcro, to attach the curtain to the curtain rod system.

2. Brief Description of the Prior Art

Curtains have been traditionally connected to rods through a variety of securing means, including hooks as well as direct application to the rod. Once a curtain is directly placed on the rod it can only be altered length wise by removal from the rod and hemming. Changing the length when hooks are used requires removing the curtain and adjusting their position and re-hanging the curtains. Curtains hung by traditional means also do not release when pulled upon. Instead of the curtain releasing, either the entire rod assembly comes down or the curtains tear. Falling curtains and rods can also be a possible endangerment to small children, who are most likely to pull or climb on them.

The instant invention overcomes these problems by disclosing a method of hanging curtains that are easily adjustable and release when pressure is applied.

BRIEF DESCRIPTION OF THE DRAWINGS

The advantages of the instant disclosure will become more apparent when read with the specification and the drawings, wherein.

SUMMARY OF THE INVENTION

A curtain hanging device consisting of a rod, with a substantially rectangular cross section and an open channel running along its length on one side. The channel is dimensioned to receive an I shaped slide which slides along the channel. A concave curved portion opposite the channel is provided along the back of the rod to provide support. A pair of J shaped braces, facing opposite one another, are at right angles to the channel, and allow the I shaped slide to move between them. A pair of adjustable torque devices work in conjunction with the J shaped brace, creating torque in the rod, to prevent the I shaped slide from moving too freely within the channel. The I slides can be covered with a material which facilitates sliding, such as sold under the trademark Teflon.

The I shaped slide has one portion of a two portion self adhering material affixed to one first end to allow for attachment of the curtains. In one embodiment, the I shaped slide has a securing portion affixed, either permanently or removably, at a right angle to the first end, providing additional support for the curtain. In an additional embodiment the first end of the I shaped slide has a concave surface to interact with a hook device. The hook device is manufactured in a configuration to mate with the concave surface of the I slide with one portion of a two portion self adhering material affixed to the exposed surface. A hook fits over the top of the I slide to lock the hook device to the I slide. As an alternate embodiment, rollers are provided which come in contact with the rod. The rollers can be at least one wheel or ball bearing. An alternative to affixing the one portion of a two portion self adhering material to the I slide, a removable bag enveloping the I slide can be used.

The rod is provided with at least two pair of connecting holes on the front surface proximate the ends of the rod. These connecting holes interact with the locking tabs of a pair of curved wall braces. The curved wall braces have a diameter slightly less than that of the rod to fit within the rod. The wall braces have a cross section the same configuration of the rod, thereby allowing the I shaped slide to run within the wall braces.

The rod and wall braces are manufactured from a rigid, slightly flexible material, such as plastic or lightweight metal. It is preferable that the I shaped slide is rigid to prevent bending.

A non channel rod can be used in combination with loops which are manufactured from one portion of a two portion self adhering material. The loops are placed in movable contact with the rod to receive the second portion of a two portion self adhering material, which has been affixed to drapes.

DETAILED DESCRIPTION OF THE INVENTION

Figure 1:
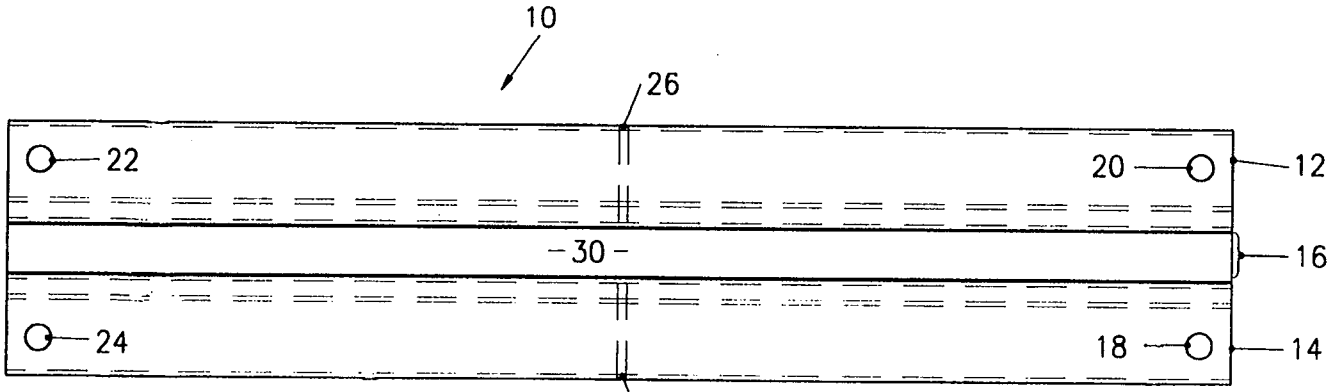
FIG. 1 is a top view of the rail system of the instant invention.

FIG. 1 illustrates a front view of a section of rail 10 of the instant invention. The top front panel 12 and the bottom front panel 14 run the length of the rail 10 and comprise the front surface which would be viewed by the user. The top front panel 12 and the bottom front panel 14 are less than the height of the back panel 30, thereby leaving slide portion 16 open to receive the spacer 54 of the slide 50 of FIG. 3. The rail 10 is provided with locking holes 18, 20, 22 and 24 which receive the locking tabs 64 as described in FIG. 4. In order to prevent the slides 50 from loosely moving within the slide portion 16, tension bolt receiving areas 26 and 28 are placed at approximately six foot intervals along the rail 10. The tension bolt areas 26 and 28 can be set at closer intervals than six foot depending upon the weight of the drapery. A standard bolt is placed in each of the tension bolt receiving areas 26 and 28 and tightened to provide torque to the rail 10 and increase the pressure of the legs of the J shaped supports of FIG. 2 against the slide 54. Optionally, a standard "C" clamp with a tension screw can be used to provide the required tension. The "C" clamp is placed on the top end 46 and the bottom end 48 and tightened a sufficient amount to cause the torque.

Figure 2:
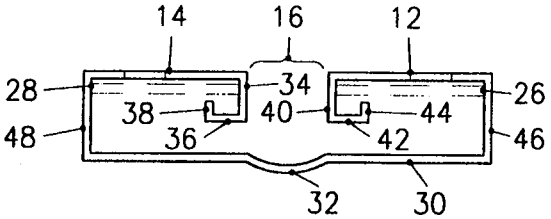
FIG. 2 is an end view of the rail of FIG. 1.

FIG. 2 illustrates the end view of the rail 10 showing in detail the pair of J shaped supports. The legs 34 and 40 of the supports are at right angles to the top front panels 12 and 14 and extend partially into width of the top end 46 and bottom end 48. The bottoms 36 and 42 of the J supports run parallel to the top front panels 12 and 14 and the tips 38 and 44 of the J supports are at right angles to the bottoms 36 and 42. The J shape of the supports provides rigidity to the rail 10 as well as providing a locking surface for the slide 50. The legs 34 and 40 of the J supports extend a sufficient distance into the width of the top end 46 and bottom end 48 to provide rigidity and prevent the slide 50 from angling within the rail 10 and thereby jamming. The legs 34 and 40 of the J supports cannot, however, extend so far into the width of the top end 46 and bottom end 48 as to prevent the slide 50 from sliding within the rail. The back panel 30 is provided with a curved support 32 which provides additional support and rigidity as well as allowing the rail 10 to torque. The support provided by the curved support 32 prevents the rail 10 from collapsing and/or kinking while allowing for the torquing flex.

Figure 3:
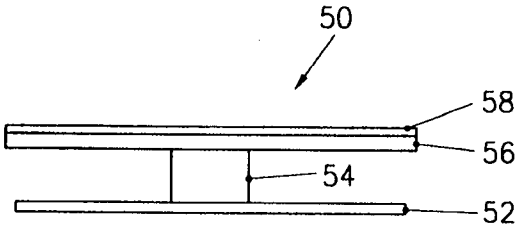
FIG. 3 is a side view of the curtain slide of the instant invention.

The I shaped slide 50 carries the curtains and is shown in FIG. 3 as a side view. The inner brace 52 fits within the rail 10 and slides in the area between the back panel 30 and the J support bottoms 36 and 42. The spacer 54 is dimensioned to bring the outer brace 56 of the slide 50 slightly beyond the top front panel 12 and bottom front panel 14. The spacer 54 must be dimensioned only slightly greater than the distance between the interior of the back panel 30 and the top front panel 12 and bottom front panel 14. The length of the spacer 54 cannot be so close as to provide a friction fit, however it cannot be so great as to cause the outer brace 56 to extend a substantial distance beyond the top front panel 12 and bottom front panel 14. It is not required that the inner brace 52 and the outer brace 58 be dimensioned to be proximate the width of the back panel 30, however the inner brace 52 and the outer brace 58 can not be so small as to turn and lock within the rail 10. The outer brace 56 has one part of a two part self affixing material such as sold under the trademark Velcro. The hook and fabric system employs a first part which consists of a crochet hook section and a loop or fabric section. For simplicity and ease of discussion, reference will be made to the two component, hook and fabric attachment system by the trademark Velcro. It should be understood that any other brand of product would also provide the desired result and that the term is intended to be inclusive of two component attachment devices which employs the hook and fabric or loop attachment mechanism of the type sold under the Velcro trademark. As well know in the art, the flexible plastic hook elements of the first component part, engage the hook or fabric fibers of the second part, providing a releasable attachment mechanism. The two parts have a high resistance to separating under a force with attempts to tear apart the two components of the Velcro ® attachment system. However, the two components separate readily under a peel force. The hook section of the Velcro device is affixed to the outer brace 58 through adhesive means as well known in the prior art. The slide 50 can be optionally coated, tipped or edged with teflon, silicon or other lubricous materials.

Figure 5:
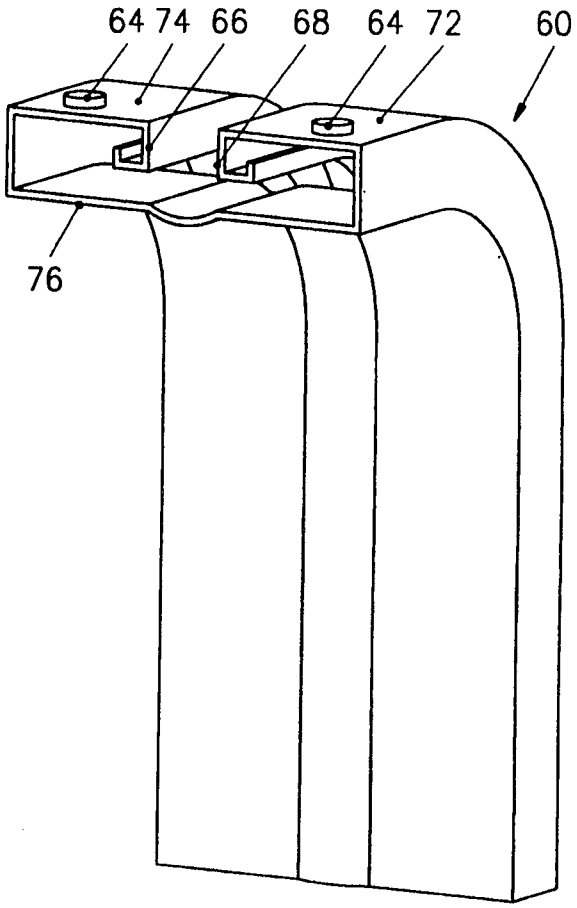
FIG. 5 is a perspective view of the attachment section of FIG. 4.
Figure 4:
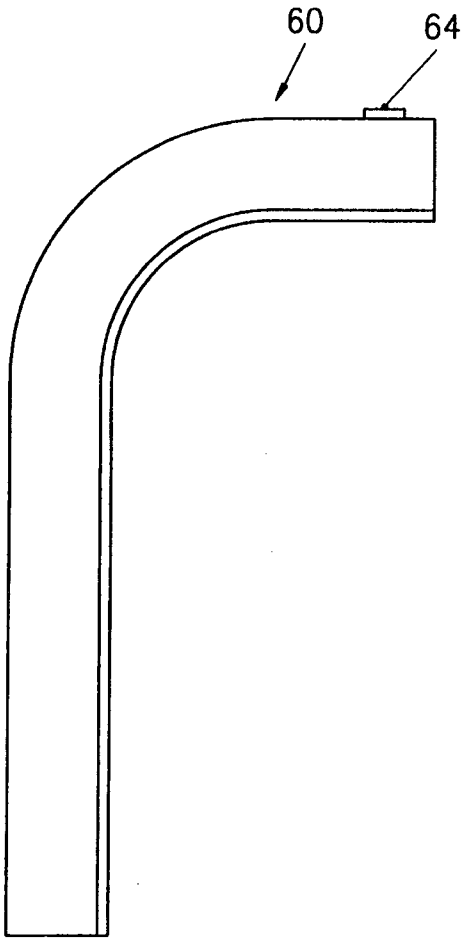
FIG. 4 is a side view of the attachment section of the instant invention.

FIGS. 4 and 5 illustrate the attachment sections 60 which are used to secure the rail 10 to the wall. The attachment sections 60 are provided with a pair of tab sections 64 and are dimensioned to fit within the rail 10. The attachment sections 60 are attached to the wall through means as well known in the curtain rod art. The attachment sections 60 are constructed the same as the rail 10 with the slide portion 70 in alignment with the slide portion 16 of the rail 10. The J shaped supports 66 and 68 provide support for the slide 50 as described in FIG. 2. The rail 10 is attached to the attachment sections 60 by sliding the attachment section 60 into the rail 10 until the tabs 64 fit through the locking holes 18, 20, 22 and 24. The outer dimension of the attachment section 60 must be only slightly less than that of the inner dimension of the rail 10 to allow for a friction fit. The friction fit prevents the attachment sections 60 from twisting within the rail 10. The tabs 64 prevent the attachment section 60 from being pulled out of the rail 10. To insert and remove the attachment section 60 from the rail 10, the user presses down on the top panel 71 and bottom panel 74, forcing the tabs 64 toward the back panel 76. The tabs 64 must be pressed a sufficient amount downward to allow the tabs 64 to clear the top panel 12 and bottom panel 14. When released, the top panel 71 and bottom panel 74 return to their previous position allowing the tabs 64 to fit within the locking holes 18, 20, 22 and 24.

Figure 6:
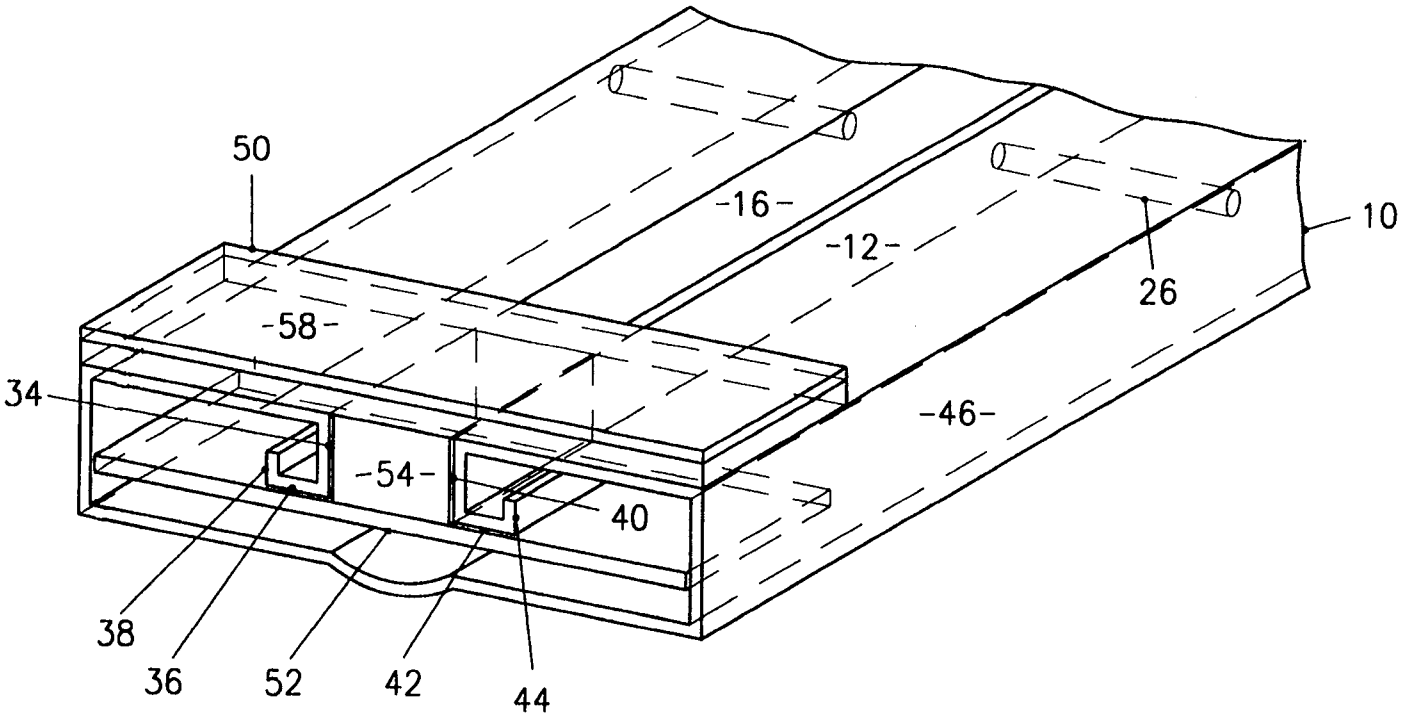
FIG. 6 is a perspective view of the rail and slide of the instant invention.

The I shaped slide 50 is illustrated in FIG. 6, placed within the rail 10. The inner brace 52 is positioned between the back panel 30 and the bottoms 36 and 42 of the J shaped supports. The spacer 54 is placed within the slide portion 16, thereby positioning the outer brace 56 to run along the top front panel 12 and back front panel 14. The spacer 54 is retained in position by the legs 34 and 40 of the J shaped supports. The weight of the drapes will slightly tilt the I shaped slide 50 causing the inner brace 52 to angle, resting on the back panel 30 and top front panel 12. This angle is slight and prevents the I shaped slide 50 from sliding within the rail 10 with slight movement of the drapes. A bolt (not shown) can be placed in the bolt receiving area 26 and tightened to apply tension to the leg 40 of the J shaped support thereby creating a slight warpage of the rail 10. This warpage prevents the slide 50 from too easily running along the slide portion 16, thereby allowing for more exacting placement of the slides 50 along the rail 10.

Figure 8:
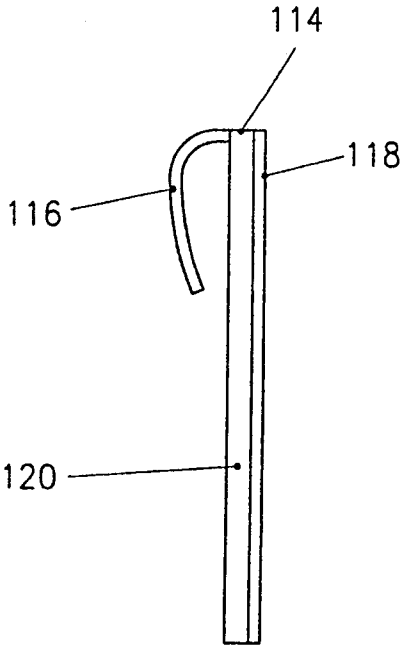
FIG. 8 is a side view of the curtain attachment portion of FIG. 7.
Figure 7:
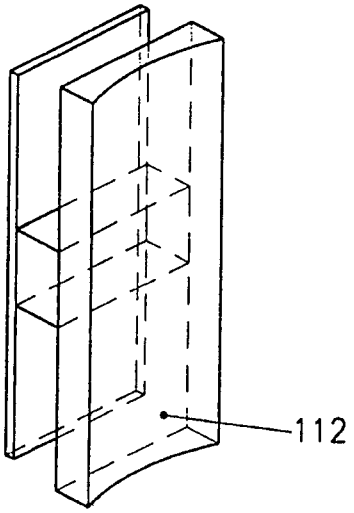
FIG. 7 is a perspective view of an alternate slide of the instant disclosure.

FIGS. 7 and 8 illustrate an alternate slide unit 110. The tab 112 is manufactured with a concave outer surface to receive the overlay 120. The mating of the concave/convex surfaces prevents the I-shaped slide from excessive horizontal movement and decreases the possibility of disengagement during use. The overlay 120 has an exterior surface which is dimensioned to mate with the concave outer surface, an interior surface which has Velcro ® affixed thereto and a hook 116 extending from the top edge 114. The hook 116 is proportioned to extend over and lock onto the tab 112 through friction fit. As an alternative, the tab 112 can be provided with a groove into which the hook 116 slides. The Velcro TM portion of the overlay 120 is affixed to the curtains prior to mounting the overlay 120 onto the slide unit 110. The desired number of slide units 110 are inserted into the curtain rod as previously disclosed herein. Once the curtains are affixed to the Velcro TM, the hook 116 on the overlay 120 is placed over the tab 112 of the slide unit 110. The rod and wall braces are manufactured from a rigid, slightly flexible material, such as plastic or lightweight metal. It is preferable that the I shaped slide is rigid to prevent bending.

What is claimed is:

1. A curtain hanging device, said curtain hanging device comprising:

a rod, said rod having a substantially rectangular cross section having a first surface, a second surface, a third surface, a fourth surface and a fifth surface, said first surface and said fifth surface being in the same plane and spaced opposite and parallel to the plane of said third surface, said first surface and said fifth surface having a lateral dimension less than that of said third surface and being spaced from each other, thereby forming a channel along said curtain hanging device;

at least one I shaped slide member, said at least one I shaped slide member having a first end, a second end and a web connecting said first end and said second end, said first end having a pair of side surfaces, said first end being dimensioned to slide within and along said channel such that said pair of side surfaces remain in a constant and substantially parallel relationship to said second and forth surfaces;

said second end having a grooved surface and a pair of horizontal surfaces, said grooved surface having a concave groove extending substantially perpendicular to the direction of travel of said at least one I shaped slide member along said channel, each of said pair of horizontal surfaces abutting said grooved surface; and an overlay, said overlay having an affixing means and a brace portion, said affixing means being disposed to removably affix said overlay to said at least one I shaped slide member, said brace portion having a mating surface and an attachment surface, said mating surface having a substantially convex portion dimensioned to mate with said concave groove of said second end of said at least one I shaped slide member, said attachment surface having one portion of a two portion self-adhering material affixed thereto.

2. The curtain hanging device of claim 1 wherein said I shaped slide is manufactured from a rigid material.

3. The curtain hanging device of claim 2 wherein said material is plastic.

4. The curtain hanging device of claim 2 wherein said material is a lightweight metal.

5. The curtain hanging device of claim 1 wherein said affixing means is a hook.

6. The curtain hanging device of claim 1 wherein said affixing means is disposed to engage one of said pair of horizontal surfaces of said at least one I shaped slide member.

7. The curtain hanging device of claim 1 wherein said I shaped slide is covered in a lubricous material which facilitates movement.

8. The curtain hanging device of claim 1 wherein said third surface of said rod has a curved portion opposite said channel, said curved portion being concave in relation to said channel.

9. The curtain hanging device of claim 1 wherein said rod further comprises J shaped braces, said J shaped braces being at right angles to said channel.

10. The curtain hanging device of claim 9 wherein said J shaped braces face opposite one another.

11. The curtain hanging device of claim 1 wherein said rod further comprises at least two pair of connecting holes, said at least two pair of connecting holes being in said first surface and said fifth surface proximate the ends of said rod.

12. The curtain hanging device of claim 9 wherein said rod further comprises at least a pair of adjustable torque means, said torque means extending from said second surface and said fourth surface toward said J shaped brace, wherein when said adjustable torque means are tightened torque is created in said rod, thereby preventing said I shaped slide from moving freely.

13. The curtain handing device of claim 10 wherein said brace of said I shaped slide is positioned between said J shaped braces.

14. The curtain hanging device of claim 1 further comprising at least a pair of wall braces, said wall braces having a first portion and a second portion, said first portion and said second portion being at right angles to one another and connected by a curve.

15. The curtain hanging device of claim 14 wherein said at least a pair of wall braces further comprises having a substantially rectangular cross section with a first surface, a second surface, a third surface, a fourth surface and a fifth surface, said first surface and said fifth surface being on the same plane and opposite said third surface, said first surface and said fifth surface having an area less than that of said third surface thereby forming a channel along said at least a pair of wall braces.

16. The curtain hanging device of claim 15 wherein said third surface of said at least a pair of wall braces has a curved portion opposite said channel, said curved portion being concave in relation to said channel.

17. The curtain hanging device of claim 15 wherein said rod further comprises J shaped braces, said J shaped braces being at right angles to said channel.

18. The curtain hanging device of claim 17 wherein said J shaped braces face opposite one another.

19. The curtain hanging device of claim 11 wherein said at least a pair of wall braces further comprises at least two pair of connecting tabs, said at least two pair of connecting tabs being in said first surface and said fifth surface proximate the ends of said wall braces and dimensioned to be inserted in said connecting holes of said rod.

20. The curtain hanging device of claim 15 wherein each of said pair of wall braces is dimensioned to be recieved within a respective end of said rod.

21. The curtain hanging device of claim 15 wherein said pair of wall braces are manufactured from a rigid, slightly flexible material.

22. The curtain hanging device of claim 21 wherein said material is plastic.

23. The curtain hanging device of claim 21 wherein said material is a lightweight metal.

24. The curtain hanging device of claim 1 wherein said rod is manufactured from a rigid, slightly flexible material.

25. The curtain hanging device of claim 24 wherein said material is plastic.

26. The curtain hanging device of claim 25 wherein said material is a lightweight metal.

* * * * *